US007402049B2

(12) United States Patent
Polnyi

(10) Patent No.: US 7,402,049 B2
(45) Date of Patent: Jul. 22, 2008

(54) CONTACT FOR AN INTERPOSER-TYPE CONNECTOR ARRAY

(75) Inventor: Igor Polnyi, Aurora, IL (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/509,132

(22) Filed: Aug. 24, 2006

(65) Prior Publication Data

US 2008/0050939 A1 Feb. 28, 2008

(51) Int. Cl.
*H01R 12/00* (2006.01)

(52) U.S. Cl. ..... 439/66; 439/733.1

(58) Field of Classification Search ..... 439/66, 439/591, 71, 862, 65, 733.1
See application file for complete search history.

(56) References Cited

U.S. PATENT DOCUMENTS 4,161,346 A * 7/1979 Cherian et al. ..... 439/66
4,998,886 A * 3/1991 Werner ..... 439/66
5,427,535 A * 6/1995 Sinclair ..... 439/66
5,653,598 A * 8/1997 Grabbe ..... 439/66
5,984,693 A * 11/1999 McHugh et al. ..... 439/66
6,176,707 B1 * 1/2001 Neidich et al. ..... 439/66
6,217,342 B1 * 4/2001 Neidich et al. ..... 439/66
6,241,531 B1 * 6/2001 Roath et al. ..... 439/66
6,290,507 B1 * 9/2001 Neidich et al. ..... 439/66
6,315,576 B1 * 11/2001 Neidich ..... 439/66
6,398,559 B2 * 6/2002 Tanaka ..... 439/66
6,730,134 B2 * 5/2004 Neidich ..... 29/25.01
6,821,163 B2 * 11/2004 McHugh et al. ..... 439/733.1
6,832,917 B1 * 12/2004 Neidich ..... 439/66
6,843,659 B2 * 1/2005 Liao et al. ..... 439/66
6,905,343 B1 * 6/2005 Neidich ..... 439/66
6,942,495 B2 * 9/2005 Liao et al. ..... 439/66
6,976,888 B2 * 12/2005 Shirai et al. ..... 439/862
7,048,549 B1 * 5/2006 Swain ..... 439/66
7,052,284 B2 * 5/2006 Liao et al. ..... 439/66
7,115,005 B2 * 10/2006 Zhu et al. ..... 439/862
7,147,477 B2 * 12/2006 Soh ..... 439/66
7,198,493 B2 * 4/2007 Chen et al. ..... 439/66

* cited by examiner

*Primary Examiner*—Renee S Luebke
*Assistant Examiner*—Vanessa Girardi
(74) *Attorney, Agent, or Firm*—Wei Te Chung

(57) ABSTRACT

An electrical connector (1) includes an insulative housing (10) and a plurality of stamped contacts (12) resided therewithin. The conductive contact includes a central spring beam (122), a side spring beam (124) located at one side of the central spring beam, and a contact portion (121) formed between the central spring beam and the side spring beam for electrically mating with a mating component. The central spring beam extends inwardly of the contact portion and towards an end portion of the side spring beam. Such a configuration of the central spring beam will ensure that the conductive contact has a predetermined robustness thereof while possessing the required spring properties for the stamped contact.

15 Claims, 10 Drawing Sheets

2

CONTACT FOR AN INTERPOSER-TYPE CONNECTOR ARRAY

BACKGROUND OF THE INVENTION

1. Field of the Invention

The present invention relates to the art of electrical connectors, and more particularly to a stamped contact for use in an electrical connector.

2. General Background

Electrical connectors are used for forming electrical connections between spaced contact pads on adjacent parallel circuit members, such as an IC package and a substrate. The electrical connector typically includes an insulative housing and a plurality of conductive contacts resided within the insulative housing. The conductive contacts extend towards top and bottom sides of the insulative housing in order to establish the electrical connection between the aligned pairs of contact pads through the electrical connector sandwiched between the two parallel members. Making good and reliable electrical connections between the pads of the two members typically requires the conductive contact to have a robust capability so as to withstand a normal force resulted from compression actions of the two parallel member, in addition to having a good current through capability for the conductive contact. Failure of a single conductive contact to make a reliable connection renders the entire frame useless. Further, the electrical connector should occupy a minimum width between the two spaced members, requiring that the individual conductive contacts in the electrical connector to have a limited height while possessing the required spring properties for establishing reliable electrical connections between the contact pads.

In addition, the conductive contacts should be loosely or floatably confined within the electrical connector in order to ensure coplanarity of the conductive contacts with respect to the respective circuit members, such as the IC package and/or the substrate if, in some instances, the circuit member may be deformed due to temperature influences. The floating requirement of the conductive contacts also helps the conductive contacts in forming the reliable electrical connections between the spaced circuit members. Therefore, there is a need to provide a new electrical connector to resolve at least one of the above-mentioned problems.

SUMMARY OF THE INVENTION

A stamped contact for an electrical connector is provided according to one embodiment of the present invention. The stamped contact is formed from a sheet of conductive terminal, and includes a middle spring piece residing within a passage of a connector body, a contact portion on a distal region of the middle spring piece for engaging a mating conductive element, and a side spring piece extending downwardly from the contact portion. Retention structure is located near an end area of the side spring piece and adapted from engaging one side wall of the passage to be floatably retained on the connector body. Thus, such a floatable retention of the conductive contact onto the electrical connector will ensure coplanarity of the conductive contacts with respect to respective circuit members, such as an IC package and the substrate if, in some instances, the circuit members may be deformed due to temperature influences.

An electrical connector according to another embodiment of the present invention includes an insulative housing and a stamped contact. The insulative housing defines a mating side adapted to mating with a mating component, and a mounting side adapted to face a substrate. The stamped contact is formed from a sheet of conductive material. The conductive contact includes an upper contact portion extending substantially to the mating side for electrically mating with a contact portion of the mating component, a lower contact portion extending towards the mounting side for electrically connecting to a conductive element of the substrate, and a central spring beam extending between the upper contact portion and the lower contact portion. At least a portion of the central spring beam extends inwardly of the upper contact portion and the lower contact portion. Such a configuration of the central spring beam will ensure that the conductive contact has a predetermined robustness thereof while possessing the required spring properties, in addition to having the upper contact portion and the lower contact portion located more adjacent to each other so as to enable the contact to be placed within a limited height between the mating component, such as an IC package, and the substrate.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
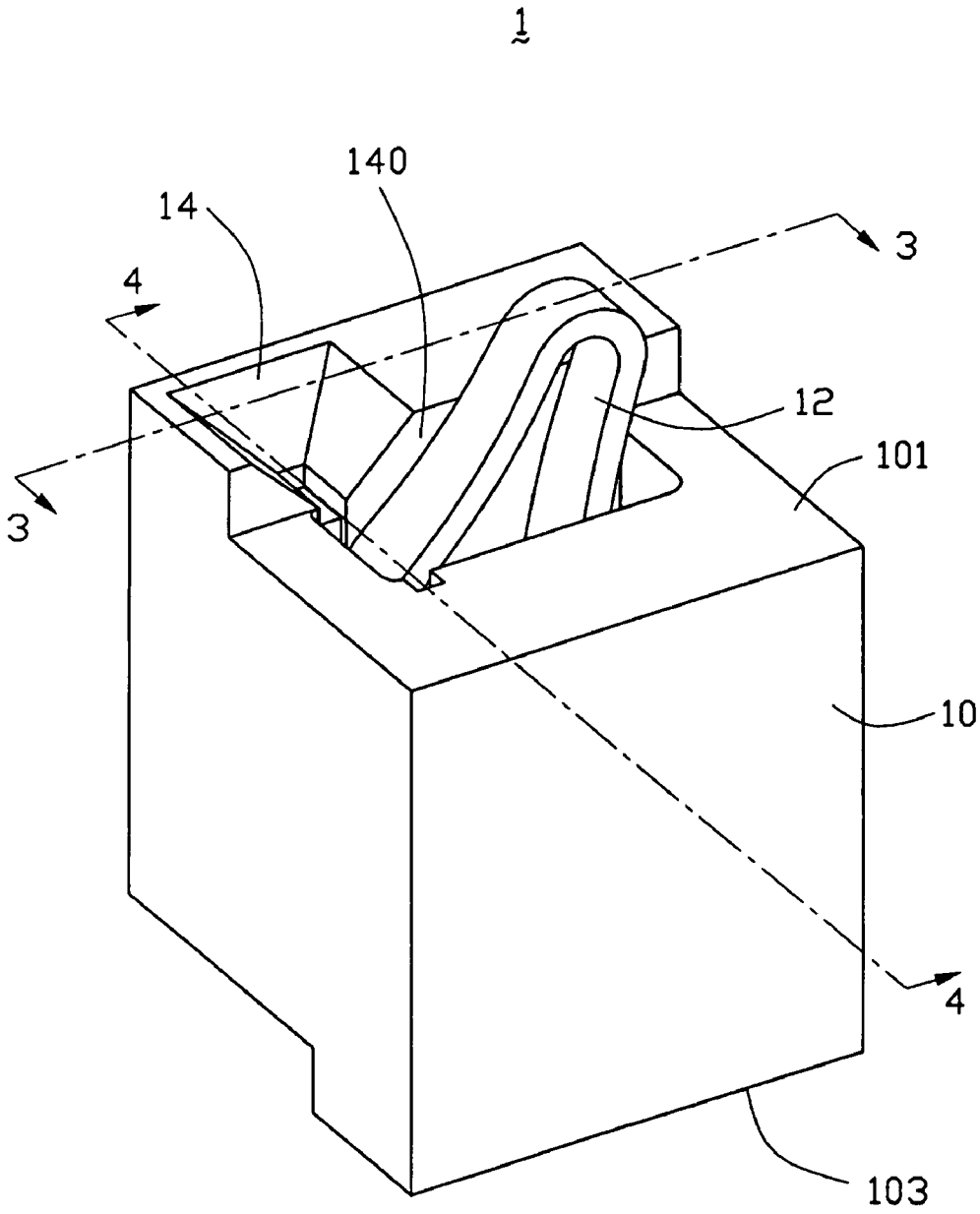
FIG. 1 is an assembled, perspective view of a part of an electrical connector according to a first embodiment of the present invention.
Figure 3:
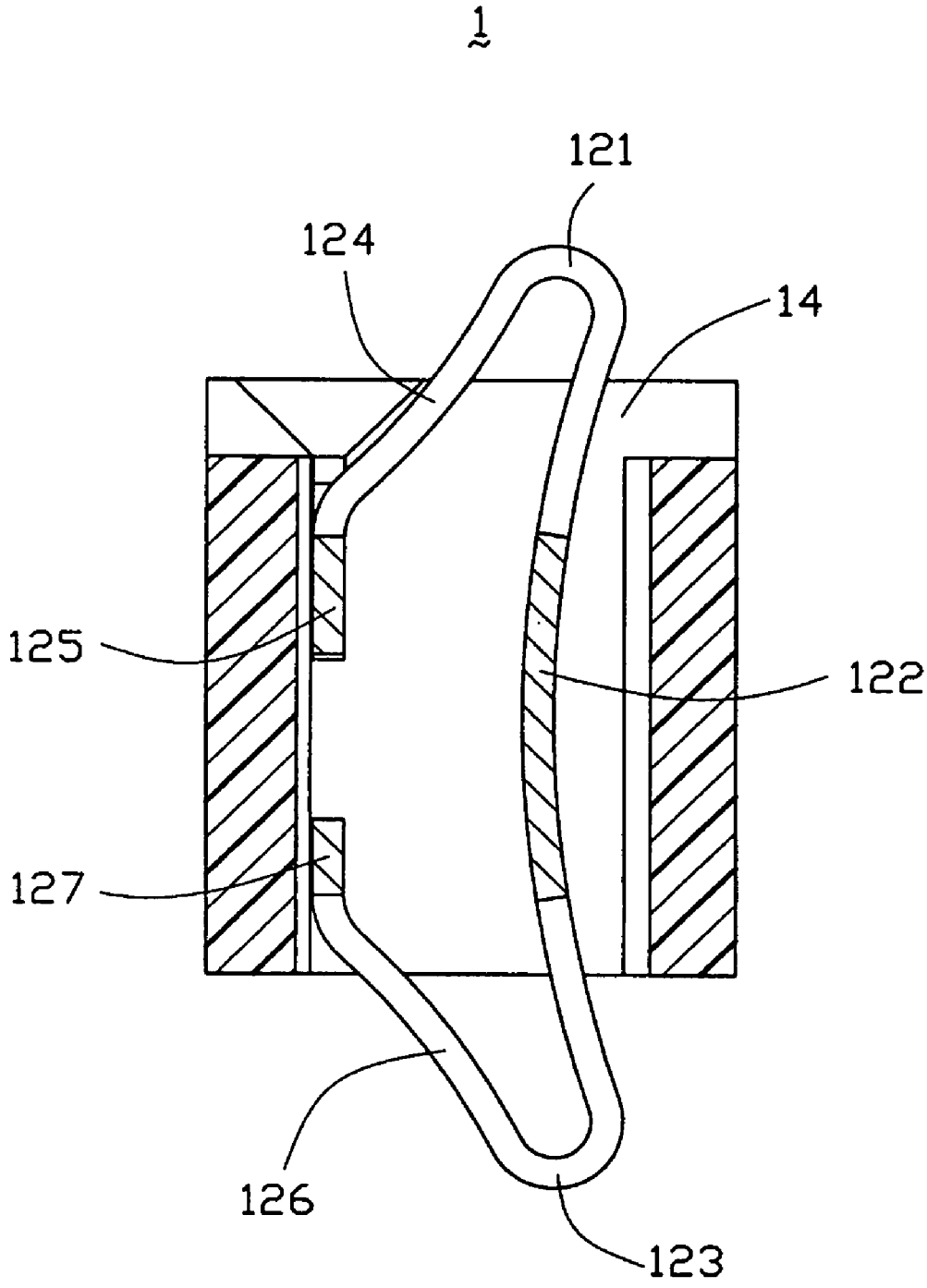
FIG. 3 is a cross-sectional view of the electrical connector of FIG. 1 taken along line 3-3 thereof.
Figure 4:
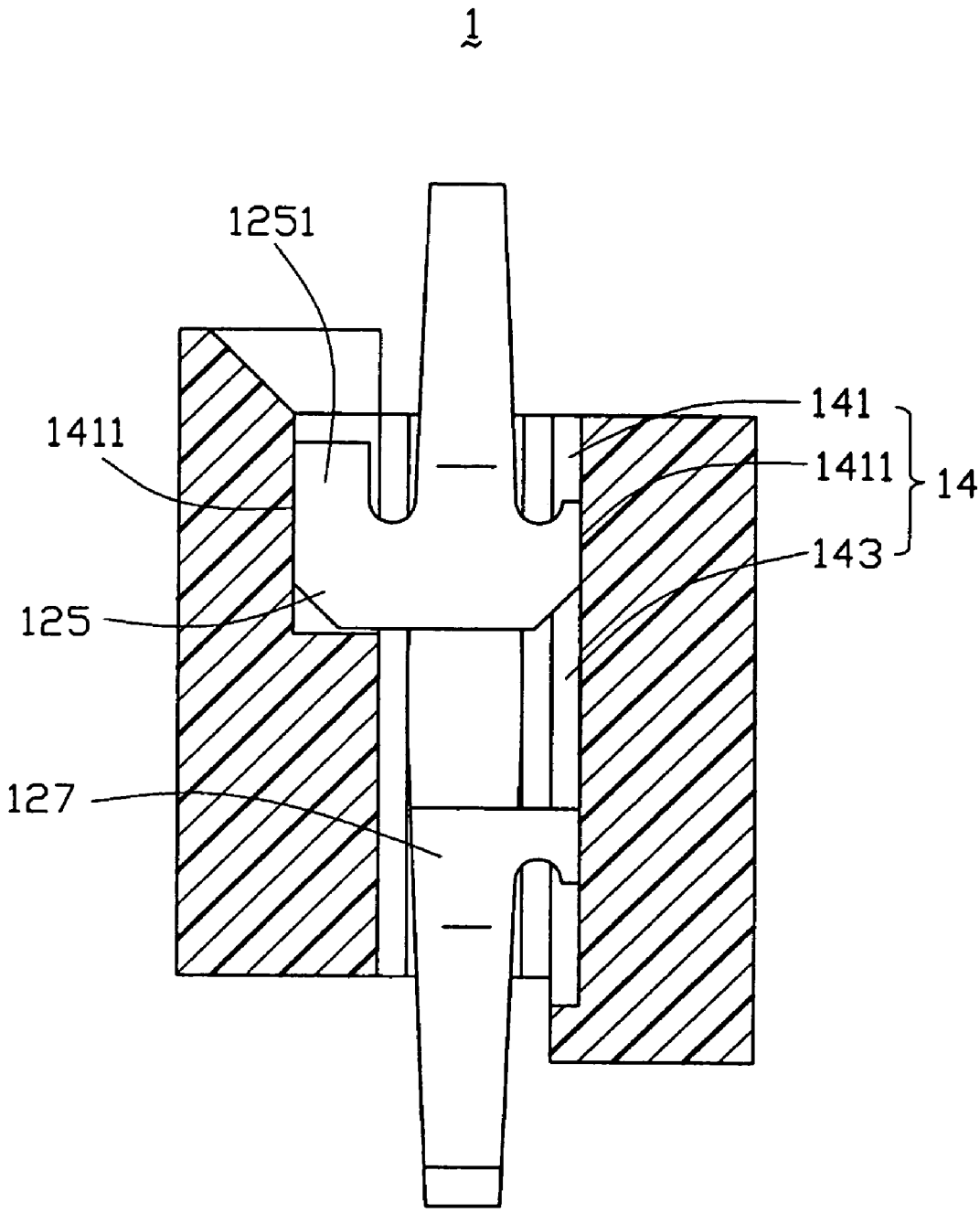
FIG. 4 is a cross-sectional view of the electrical connector of FIG. 1 taken along line 4-4 thereof.

Referring to FIGS. 1, 3 and 4, an electrical connector 1 according to the first embodiment of the present invention is shown to include an insulative housing or connector body 10, and a plurality of conductive contacts 12 resided within the insulative housing 10. For the illustration purpose, merely a part of the electrical connector 1 is included. The insulative housing 10 defines a mating side 101 adapted to mate with a mating electrical member or component, such as an IC package (not shown, as known in the prior art), and an opposite mounting side 103 adapted to face an electrical member, such as a substrate (not shown, as known in the prior art), and includes a plurality of passages 14 extending from the mating side 101 towards the mounting side 103 through the insulative housing 10.

Figure 2:
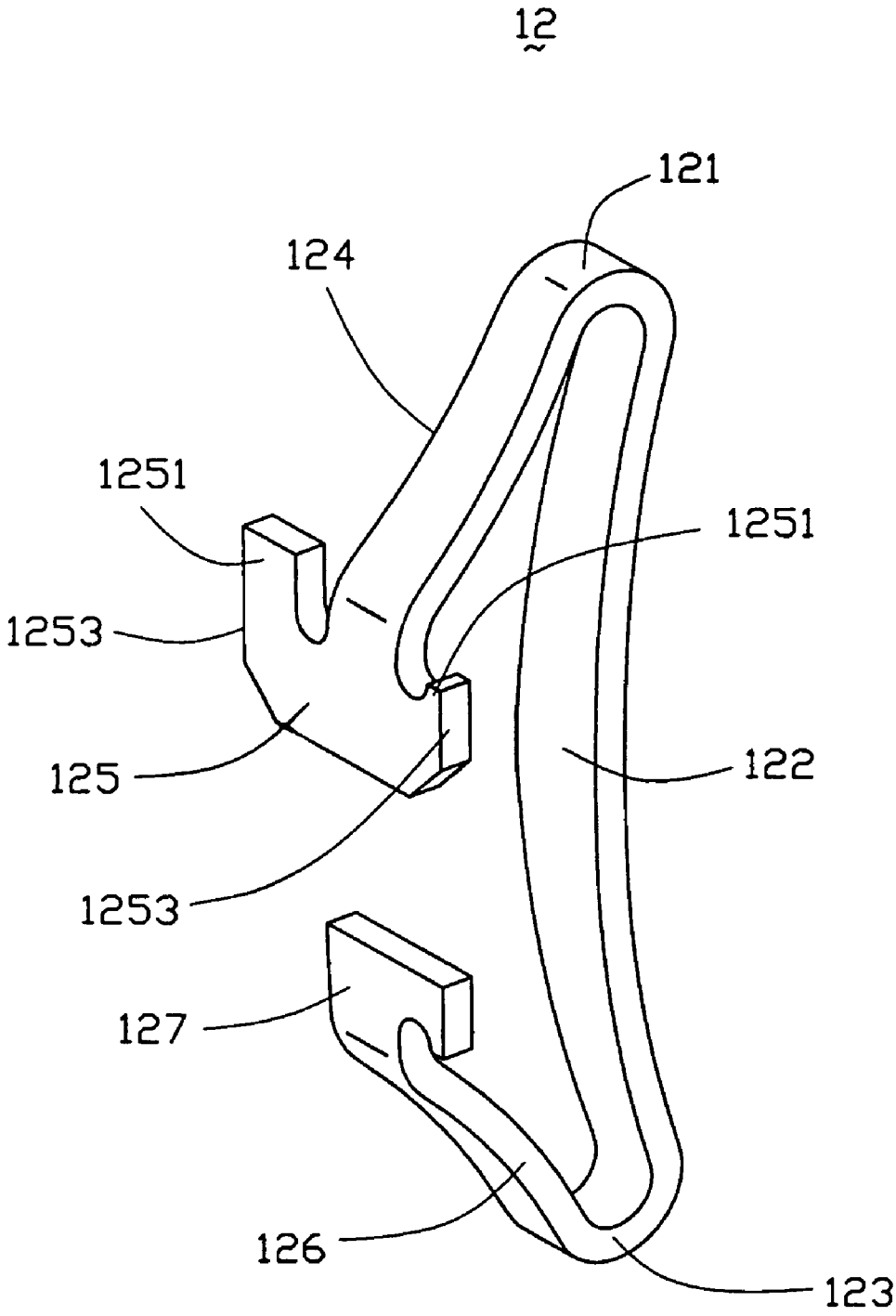
FIG. 2 is a perspective view of a conductive contact of the electrical connector of FIG. 1.

Referring to FIG. 2, the conductive contact 12 is stamped from a single sheet of conductive material. The conductive contact 12 includes a middle spring beam or piece 122 resided within one passageway 14 of the insulative housing 10, a pair of opposite side spring pieces 124 and 126 located at opposite sides of the middle spring piece 122 respectively, and upper and lower contact portions 121 and 123 formed between the upper and lower side spring pieces 124 and 126 and the middle spring piece 122 to respectively extend substantially to the mating side 101 and the mounting side 103 of the insulative housing 10. Referring to FIG. 3, in this embodiment, the upper and lower contact portions 121 and 123, in free forms, project above the respective sides 101 and 103 so as to electrically mating with a conductive element or contact of the IC package and a contact pad of the substrate. Each of the upper and lower contact portions 121 and 123 is configured to have a curved shape so as to provide a relatively contact surface for electrically mating with the IC package or the substrate. Each of the side spring pieces 124 and 126 extends inwardly and downwardly from the corresponding contact portion 121 or 123. At least one portion of the middle spring beam 122 extends inwardly of the upper contact portion 121 and the lower contact portion 123. In this embodiment, the whole middle spring piece 122 has a common radius, and is further extends laterally or bent towards an end portion of the corresponding side spring piece 124 or 126. This configuration and shape of the middle spring piece 122 will ensure that the conductive contact 12 has a predetermined robustness thereof while possessing the required spring properties, in addition to having the upper contact portion 121 and the lower contact portion 123 located more adjacent to each other so as to enable the conductive contact 12 to be placed within a limited height between the two spaced electrical members, such as the IC package and the substrate, in order for establishing reliable electrical connections between the contacts of the two electrical member. In this embodiment, the middle spring piece 122, the side spring pieces 124 and 126, and the contact portions 121 and 123 are of a same width, except for a middle section of the middle spring piece 122 for robustness considerations.

The conductive contact 12 further includes an upper end piece 125 attached to the upper side spring piece 124, and a lower end piece 127 attached to the lower side spring piece 126, with the lower end piece 127 structurally different from that of the upper side spring piece 125. More specifically, the upper end portion 125 has a width thereof greater than that of any one of the middle spring piece 122, the side spring pieces 124 and 126, and the contact portions 121 and 123 for retention consideration, while the lower end portion 127 has a width thereof greater than that of the adjacent side spring piece 126, but less than that of the upper end portion 125. A pair of retention protrusions 1251, acting as retention structure, is formed at opposite sides of the upper end portion 125, with opposite side faces 1253 defined for engaging parallel side walls 1411 of an upper side slot 141 of the electrical connector 1 (to be later described) in order to floatably retain the conductive contact 12 on the insulative housing 10 in such a manner to prevent the conductive contact 12 from being removed from the passageway 14. Such retention structure of the conductive contact 12 may allow the conductive contact 12 to be vertically movable with a predetermined distance along a length of the passageway 14 if needed for coplanarity reasons. The lower end piece 127 is free, and shaped and sized to be accommodated within a lower side slot 143 of the electrical connector 1 (to be later described) so as to allow the middle spring piece 122 to deflect and spring back. It should be noted that, in this embodiment, the upper end piece 125 and the lower end piece 127 have respective corner portions cut off or removed for achieving a smallest pitch for the electrical connector 1.

Each of the passageways 14 includes a main slot 140 adapted for receiving the middle spring piece 122, the upper side slot 141 adapted for floatably retaining the conductive contact 12 in the insulative housing 10, and the lower side slot 143 in communication with the upper side slot 141 for the lower end piece 127 to be movable in a vertical direction so as to permit the deflection of the middle spring piece 122 through the free lower end piece 127.

Referring also to FIGS. 1 to 4, in assembly, the conductive contact 12 is insertable into the passageway 14 of the electrical connector 1 such that the middle spring piece 122 and the pair of side spring pieces 124 and 126 are accommodated with the main slot 140, the upper end piece 125 is floatably secured within the upper side slot 141 in such a manner to prevent the conductive contact 12 from being removed from the passageway 14, and the free lower end piece 127 is vertically movable with respect to the passageway 14 for permitting the deflection of the middle spring piece 122 through the free lower end piece 127. In use, when the assembled electrical connector 1 is sandwiched between the two parallel spaced electrical members, and compressed by the two electrical members, the conductive contact 12 of the electrical connector 1 has the middle spring piece 122 further bent toward the end portions 125 and 127, with the upper end piece 125 extending more adjacent to the lower end piece 127 but not in direct contact with the lower end piece 127, thereby forming a short electrical pass merely through the middle spring piece 122. It is noted that because the retention of the contact 12 occurs at the end portion 125, the contact portions 121, 123 move in a wiping direction when the contact 12 is compressed by two electrical members. As a result, the end portions 125, 127 are located relative to the contact portions 121, 123 opposite to said wiping direction, while the spring piece 122, which forms the electrical path, is located relative to the contact portions 121, 123 along said wiping direction when the contact 12 is in a relaxed manner. On the other hand, because the spring piece 122 is curved opposite to the wiping direction, essentially it is impossible to have the spring piece 122 touch the housing wall, thus differentiating from the conventional type which defines a retention structure on the outwardly bugled spring piece abutting against the wall while leaving the distal tips free.

Figure 5:
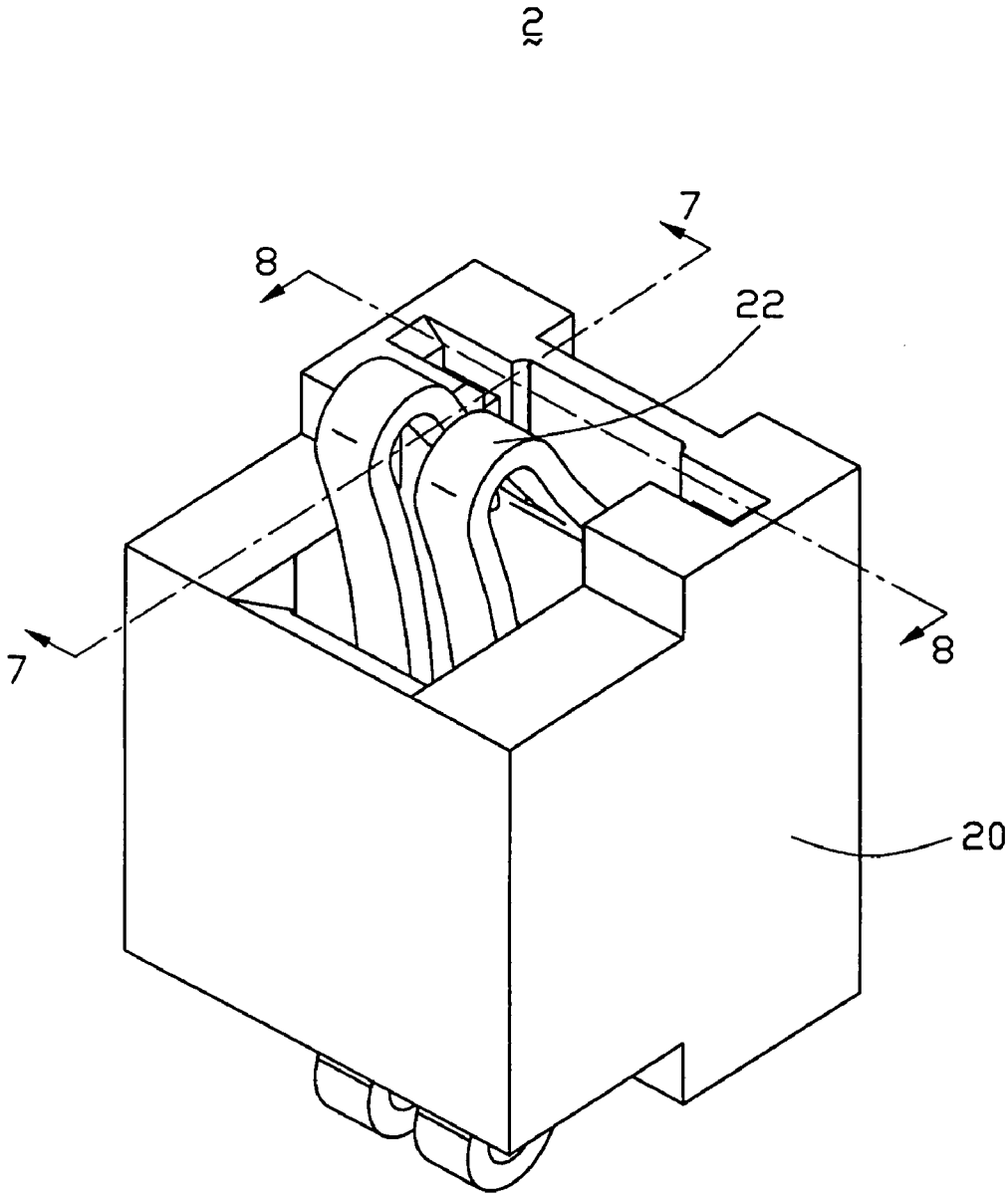
FIG. 5 is an assembled, perspective view of a part of an electrical connector according to a second embodiment of the present invention.
Figure 6:
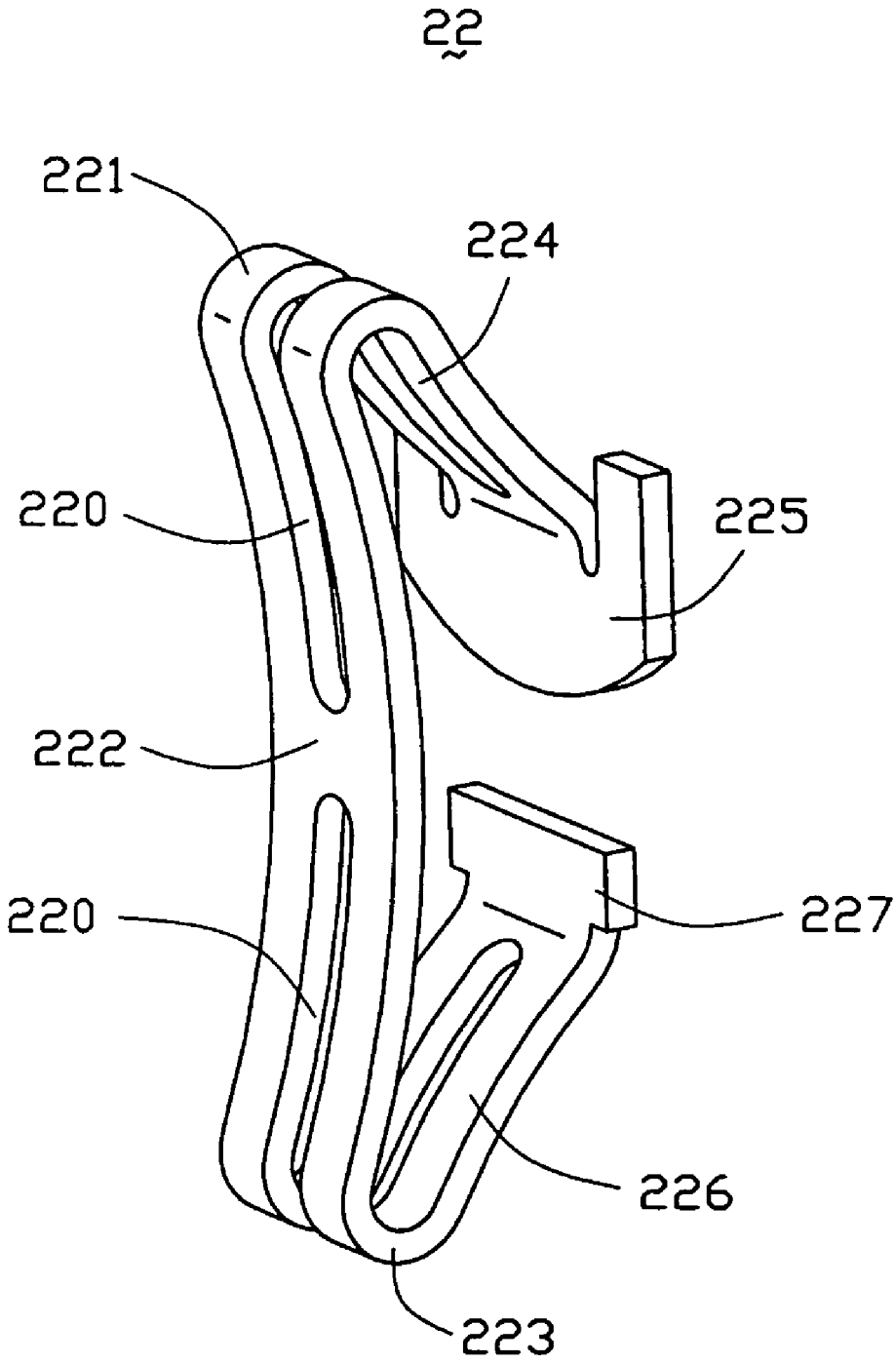
FIG. 6 is a perspective view of a conductive contact of the electrical connector of FIG. 5.
Figure 7:
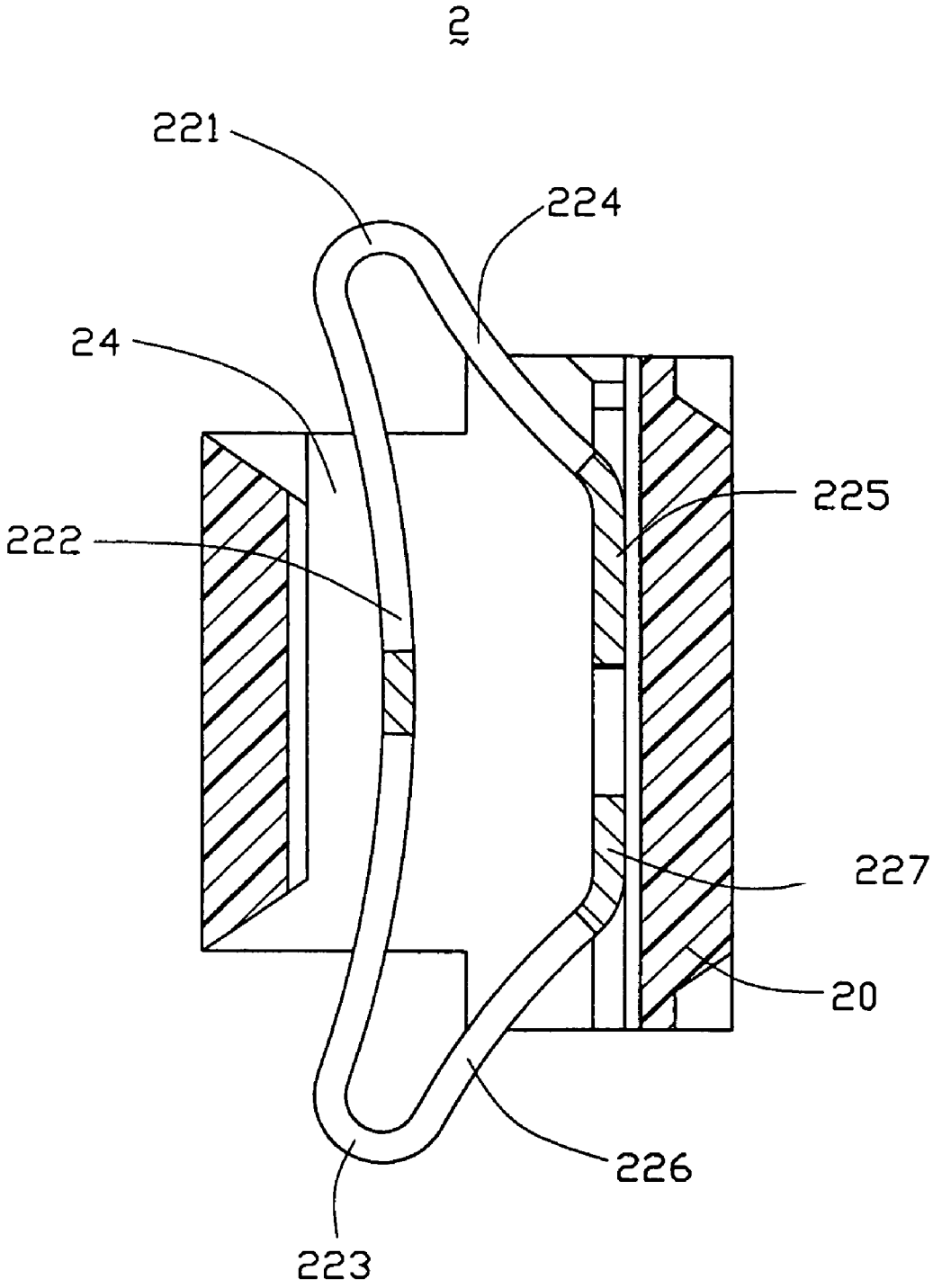
FIG. 7 is a cross-sectional view of the electrical connector of FIG. 5 taken along line 7-7 thereof.
Figure 8:
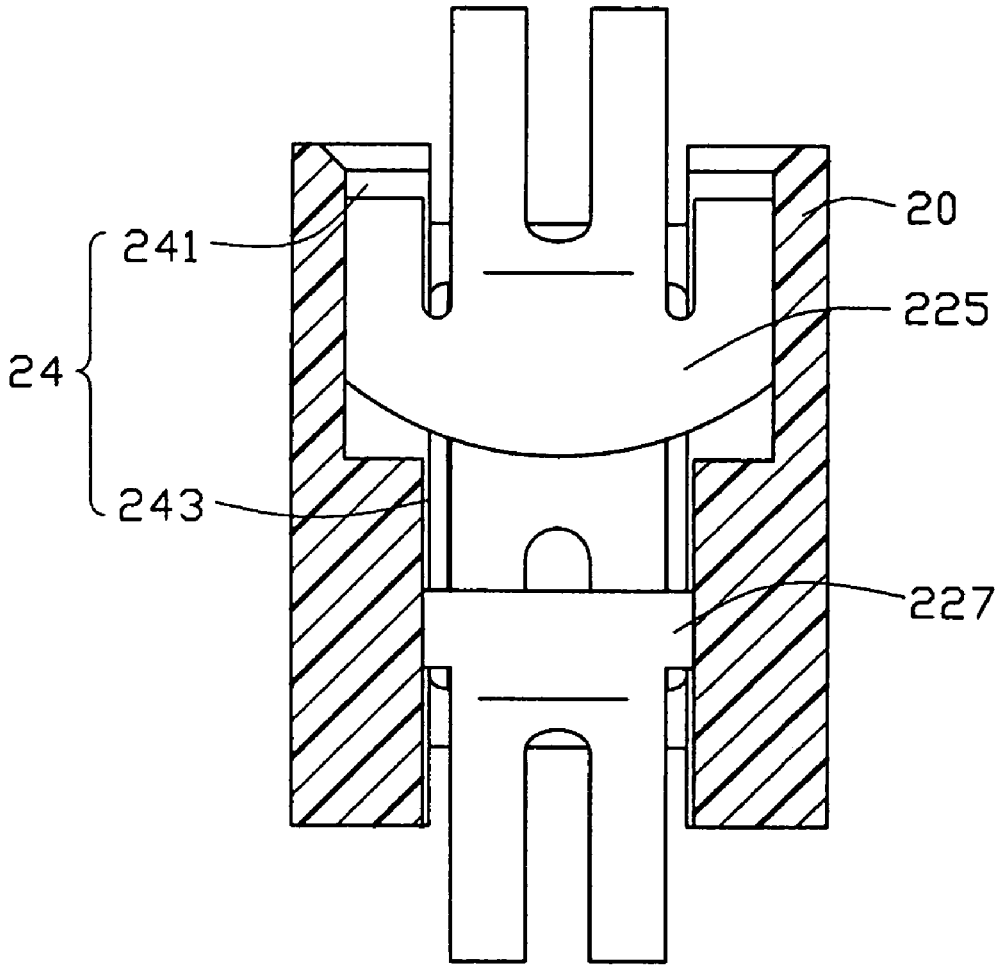
FIG. 8 is a cross-sectional view of the electrical connector of FIG. 5 taken along line 8-8 thereof.

Referring to FIGS. 5, 7 and 8, an electrical connector 2 according to the second embodiment of the present invention is shown to include an insulative housing or member 20, and a plurality of conductive contacts 22 resided within the insulative housing 20. For the illustration purpose, merely a part of the electrical connector 2 is included. The electrical connector 2 of this embodiment is similar to that of the electrical connector 1 in the relative position relationship between the respective pieces of the conductive contact, except for specific shapes of the conductive contact 22 and the passageway 24 associated with the conductive contact 22. In this embodiment, both of an upper end piece 225 and a lower end piece 227 have a symmetrical configuration, i.e. without portions thereof cut off or removed. The conductive contact 22 have a width two times greater than that of the conductive contact 12 of the first embodiment, except for the upper end piece 225 and the lower end piece 227. The passageway 24 further includes an upper side slot 241 adapted for receiving the upper end piece 225, and a lower side slot 243 adapted for receiving the lower end piece 227. The conductive contact 22 further includes an elongated slot 220 extending along a length of the middle spring piece 222, the side spring pieces 224 and 226, and the contact portions 221 and 223 except for a middle section of the middle spring piece 222 for robustness consideration. The inclusion of the slot 220 along the respective pieces and the contact portion 221 and 223 increases the flexibility of the conductive contact 22, and provides two spaced contact regions at each of the contact portions 221 and 223 for an increased contact surface with a corresponding contact pad of the mating component or electrical member.

Figure 9:
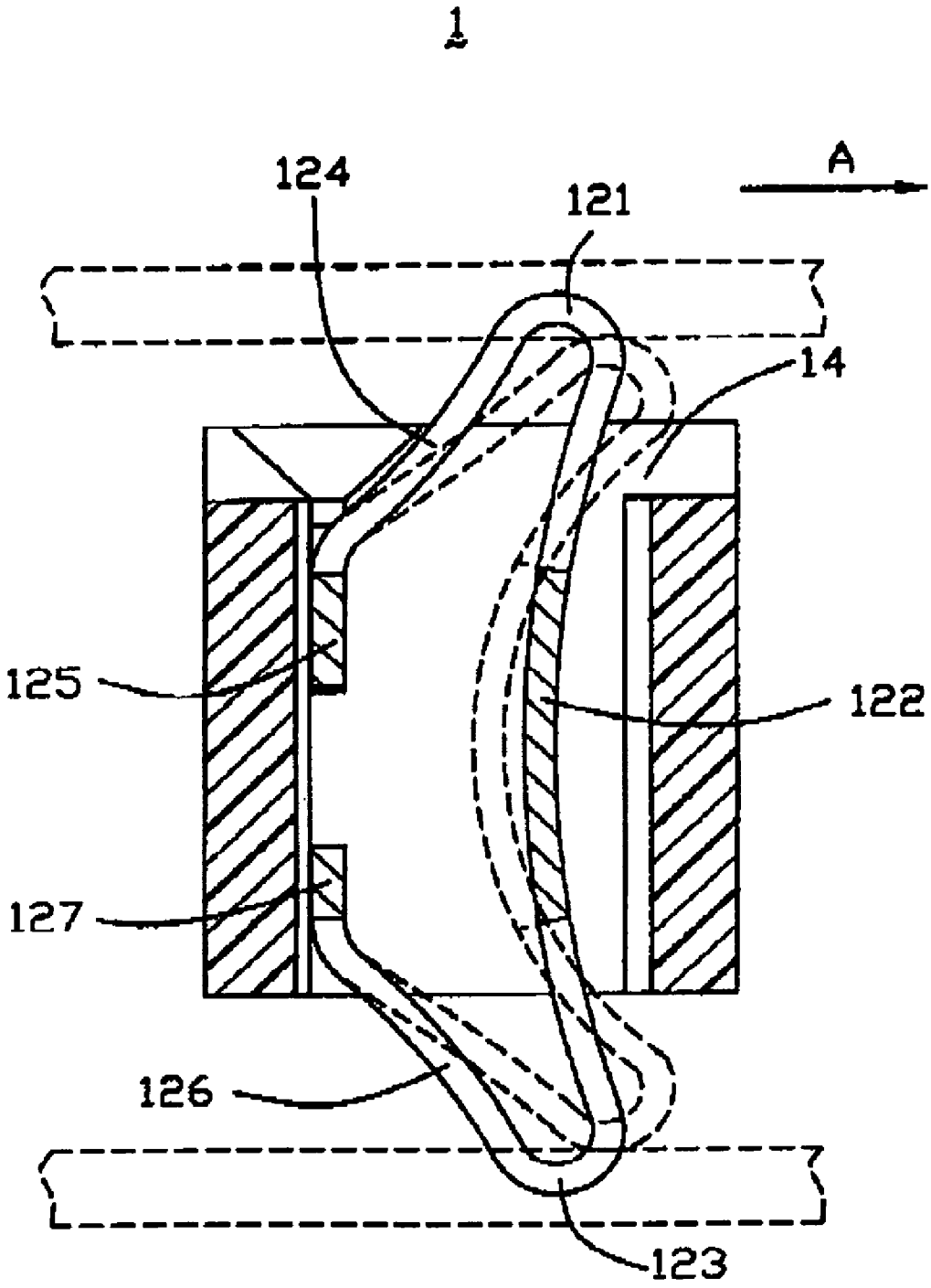
FIG. 9 is a view showing the conductive contact of FIG. 3 to be moved along a moving direction A when compressed.
Figure 10:
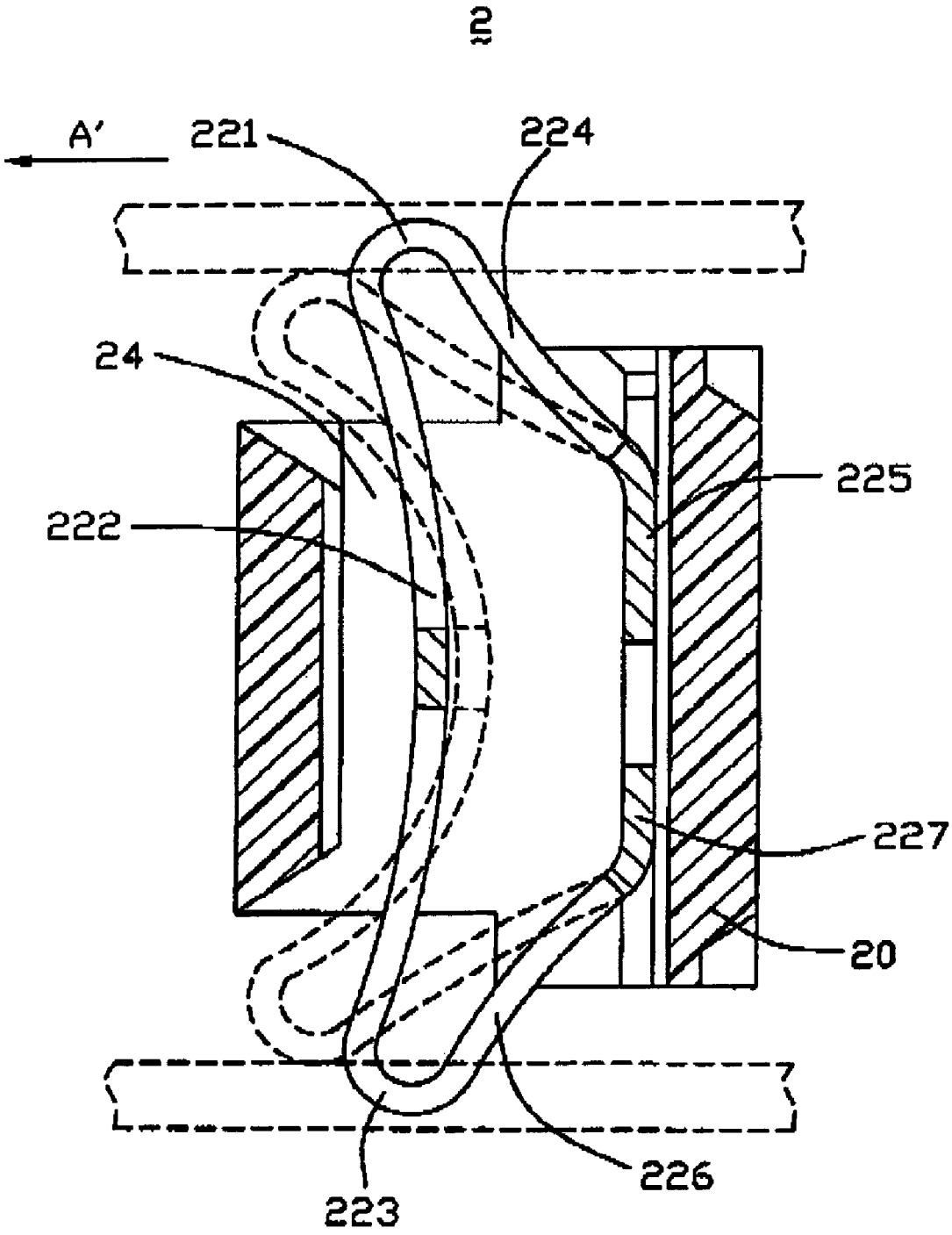
FIG. 10 is a view showing the conductive contact of FIG. 7 to be moved along a moving direction A' when compressed.

Referring to FIGS. 9 and 10, the insulative housing defines opposite upper and lower surfaces thereon and a plurality of passageway 14 or 24 extending therethrough. A plurality of contacts is disposed in the corresponding passageways 14 or 24, respectively. Each of the contacts includes opposite upper contact portions 121 or 221 and lower contact portions 123 or 223 extending beyond the corresponding upper and lower surfaces respectively. The upper contact portions 121 or 221 and lower contact portions 123 or 223 define a moving direction A or A' when the contact is compressed by at least one electrical component. Upper side springs 124 or 224 and lower side springs 126 or 226 extends downwardly and upwardly from the corresponding upper contact portions 121 or 221 and lower contact portions 123 or 223, respectively, in a direction opposite to the moving direction A or A'. At least one of said upper and lower side springs defines a retention tip 125 or 225 which is immoveable relative to the housing along the moving direction A or A'. A main spring piece 122 or 222 is connected between the upper contact portions 121 or 221 and lower contact portions 123 or 223 opposite to the upper side springs 124 or 224 and lower side springs 126 or 226 such that the main spring piece 122 or 222 essentially does not contact the housing when compressed.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. A stamped contact, formed from a sheet of conductive material, for an electrical connector, the contact comprising:

a middle spring piece residing within a passage of a connector body;

a contact portion on a distal region of the middle spring piece for engaging a mating conductive element;

a side spring piece extending downwardly from said contact portion;

retention structure near an end area of said side spring piece and adapted for engaging one side wall of said passage to be floatably retained on the connector body.

2. The conductive contact of claim 1, wherein the middle spring piece is bent toward said end area of said side spring piece.

3. The conductive contact of claim 1, wherein the middle spring piece, the side spring piece and the contact portion is of a same width, except for a middle section of the middle spring piece.

4. The conductive contact of claim 1, wherein the middle spring piece, the side spring piece and the contact portion are of a same width.

5. The conductive contact of claim 1, wherein the middle spring piece, the side spring piece and the contact portion further include a slot extending along a length of the middle spring piece, the side spring piece and the contact portion, except for a middle section of the middle spring piece.

6. The conductive contact of claim 1, further comprising an end piece attached to an end portion of the side spring piece, said end piece has a width greater than that of any one of the middle spring piece, the side spring piece and the contact portion.

7. An electrical connector comprising:

an insulative housing defining a mating side adapted to mate with a mating component, and a mounting side adapted to face a substrate;

a stamped contact formed from a sheet of conductive material, the conductive contact including an upper contact portion extending substantially to the mating side for electrically mating with a contact portion of the mating component, a lower contact portion extending towards the mounting side for electrically connecting to a conductive element of the substrate, and a central spring beam extending between the upper contact portion and the lower contact portion;

an upper end portion connected to the upper contact portion by an upper side beam therebetween said upper end portion having a width greater than that of any one of the central spring beam, the upper side spring beam and the upper contact portion; and wherein at least a portion of the central spring beam extends inwardly of the upper contact portion and the lower contact portion.

8. The electrical connector of claim 7, further comprising a retention section formed on said upper end portion for floatably retaining the contact within the insulative housing.

9. The electrical connector of claim 7, wherein the central spring beam, the upper side spring beam and the upper contact portion are of a same width, except for a middle section of the central spring beam.

10. The electrical connector of claim 7, wherein the central spring beam, the upper side spring beam and the upper contact portion are of a same width.

11. The electrical connector of claim 10, wherein the central spring beam, the upper side spring beam and the upper contact portion further include a slot extending along a length of the central spring beam, the upper side spring beam and the upper contact portion, except for a middle section of the central spring beam.

12. An electrical connector comprising:

an insulative housing defining opposite upper and lower surfaces thereon and a plurality of passageways extending therethrough;

a plurality of contacts disposed in the corresponding passageways, respectively;

each of the contacts comprising:

opposite upper and lower contact portions extending beyond the corresponding upper and lower surfaces, respectively, said upper and lower contact portions defining a moving direction when the contact is compressed by at least one electrical components;

upper and lower side springs extending downwardly and upwardly from the corresponding upper and lower contact portions, respectively, in a direction opposite to the moving direction;

at least of one of said upper and lower side springs defining a retention tip which is immoveable relative to the housing along the moving direction; and a main spring piece connected between said upper and lower contact portions opposite to said upper and lower side springs; wherein said main spring piece essentially does not contact the housing when compressed.

13. The connector as claimed in claim 12, wherein said main spring piece is essentially curved toward the direction opposite to said moving direction.

14. The connector as claimed in claim 12, wherein the housing defines a retention slot in communication with the corresponding passageway to receive one side edge of the retention tip.

15. The connector as claimed in claim 14, wherein said retention tip is floatable in the corresponding retention slot in a vertical direction perpendicular to said moving direction.

* * * * *